US005619822A

United States Patent [19]

Trompert

[11] Patent Number: 5,619,822

[45] Date of Patent: Apr. 15, 1997

[54] SASH WINDOW UNIT, AT LEAST COMPRISING A FRAME WITH A SASH WINDOW WHICH IS SLIDABLE VERTICALLY THEREIN

[76] Inventor: Michel N. Trompert, van Trigtstraat 65, 2597 VX 's-Gravenhage, Netherlands

[21] Appl. No.: 302,645

[22] PCT Filed: Mar. 9, 1993

[86] PCT No.: PCT/NL93/00054

§ 371 Date: Sep. 8, 1994

§ 102(e) Date: Sep. 8, 1994

[87] PCT Pub. No.: WO93/18262

PCT Pub. Date: Sep. 16, 1993

[30] Foreign Application Priority Data

Mar. 9, 1992 [NL] Netherlands ..... 9200431

[51] Int. Cl.[6] ..... E05D 15/10

[52] U.S. Cl. ..... 49/209

[58] Field of Search ..... 49/209, 213, 214

[56] References Cited

U.S. PATENT DOCUMENTS

| | | | |
|---|---|---|---|
| 1,551,510 | 8/1925 | Campbell | 49/209 |
| 1,629,017 | 5/1927 | Burroughs . | |
| 1,738,183 | 12/1929 | Hickman | 49/209 |
| 2,426,474 | 8/1947 | Trammell, Sr. et al. | 49/209 |
| 5,012,611 | 5/1991 | Hsu . | |

FOREIGN PATENT DOCUMENTS

| | | | |
|---|---|---|---|
| 0438778 | 7/1991 | European Pat. Off. | E05D 15/22 |
| 1240020 | 7/1960 | France | 49/209 |
| 2339045 | 8/1977 | France | E05D 15/20 |
| 664160 | 8/1938 | Germany . | |
| 1326727 | 8/1973 | United Kingdom | E06B 3/46 |
| 1515648 | 6/1978 | United Kingdom | E06B 3/06 |
| 2226357 | 6/1990 | United Kingdom | E06B 3/42 |
| WO86/03541 | 6/1986 | WIPO | E05D 15/06 |

*Primary Examiner*—Philip C. Kannan
*Attorney, Agent, or Firm*—Deveau, Colton & Marquis

[57] ABSTRACT

Sash window unit, at least comprising a frame with a sash window which is slidable vertically therein, the frame being provided with a guideway which can interact with one or more guide parts on the sash window, sealing means between the sash window and the frame, and means for holding the sash window balanced in an open position, the guide parts being stationary relative to the sash window, and closing means are present on the frame for, at least near a closed position of the sash window, placing said sash window in sealing contact with the frame, with the interposition of the sealing means, and on release to make the sash window slidable without appreciable friction.

6 Claims, 9 Drawing Sheets

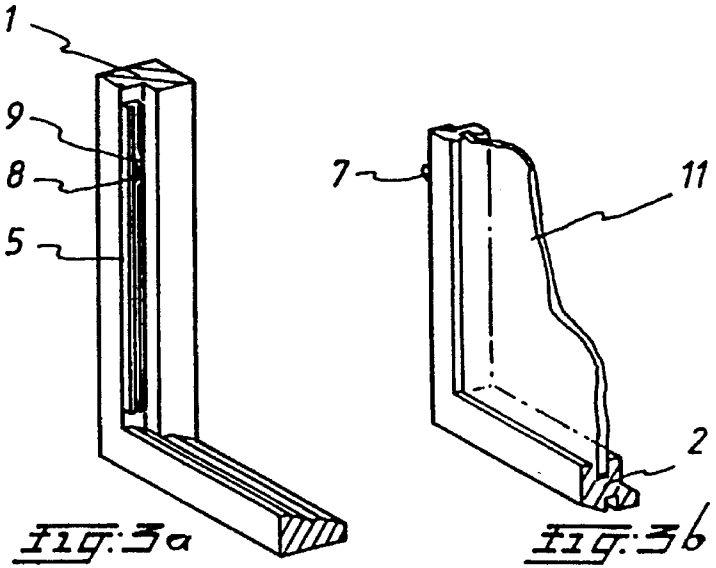
FIG. 3a
FIG. 3b
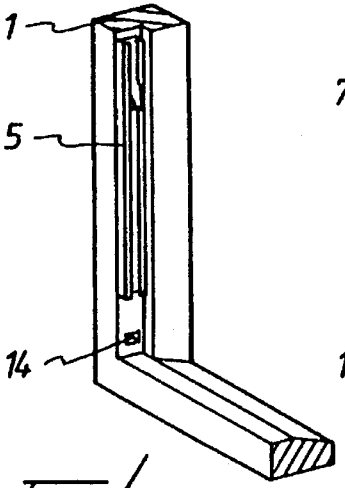
FIG. 4a
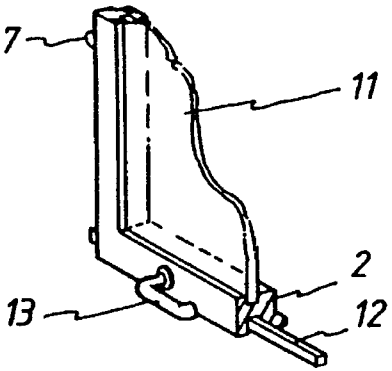
FIG. 4b
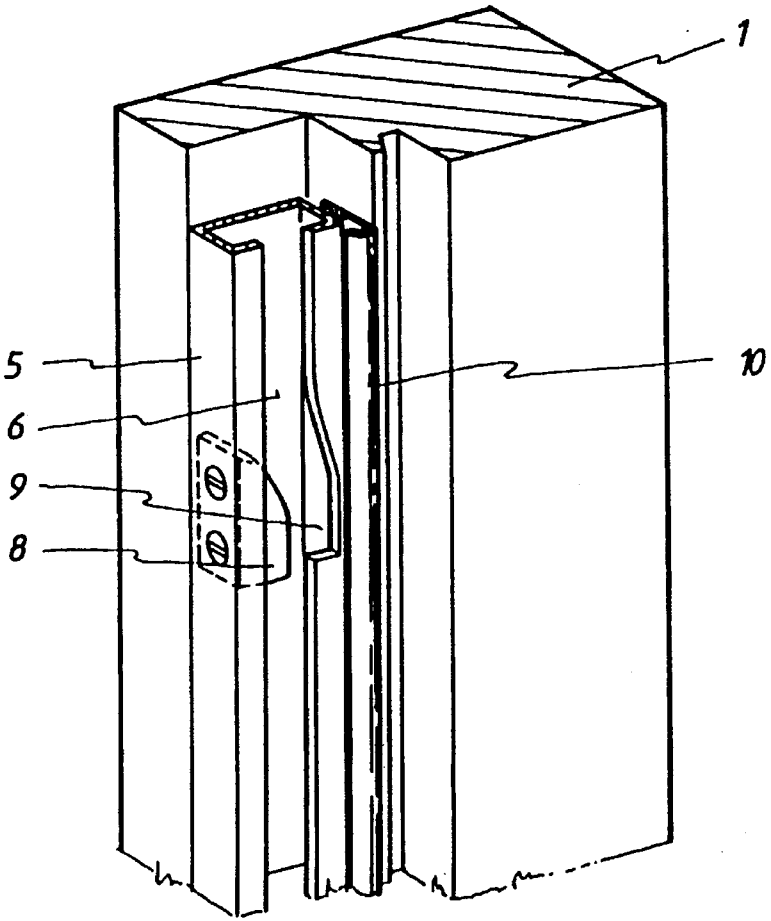
FIG. 2

SASH WINDOW UNIT, AT LEAST COMPRISING A FRAME WITH A SASH WINDOW WHICH IS SLIDABLE VERTICALLY THEREIN

The present invention relates to a sash window unit, at least comprising a frame with a sash window which is slidable vertically therein by means of two guideways comprising a single track, which can interact with one or more guide parts, sealing means between the sash window and the frame, closing means for moving the sash window relative to the frame at substantially right angles to the plane of the sash window over a relatively small distance for at least near a closed position of the sash window, placing said sash window in sealing contact with the frame, with the interposition of the sealing means, and on release to make the sash window slidable without appreciable friction and means for holding the sash window balanced in an open position Such a sash window unit is known from EP-A-0 438 778. The sash window disclosed in said European application comprises means on the sash window for moving the guide parts relative to the sash window. Said means comprise a handle coupled with angle bars, on which the guide parts are mounted.

The presence of movable guide parts on the sash window itself has the disadvantage that with such a sash window unit always relatively large side members of the sash window are necessary to house the respective components. This is especially considered to be a drawback in case of large sash windows, which may sometimes have a large area of up to 7 $m^2$, as these windows will then become excessively heavy, giving rise to extremely large forces exerted on the guide parts and coupled components with consequent increased wear.

Sash window units have been in use for over a century already for many buildings, such as houses, factory workshops etc. The invention is, of course, not limited to such older sash windows, but can also be used in the case of sash window units yet to be fitted. Sash windows have the advantage that they do not involve swinging windows or the like, and are thus not affected by wind. Moreover, windows which swing outwards in houses directly beside the street or a pavement are forbidden, and windows swinging inwards require empty window sills. A relatively large area of a window can be opened in a simple way in the case of sash windows.

The means for holding the sash window balanced in an open position are often designed in the form of a counterweight which is connected by a cord to the sash window by means of a pulley, and which lies in a weight shaft in or near the frame.

Apart from the practical advantages, the appearance of sash windows also gives them an aesthetic advantage compared with other types of windows.

Sash window units are still being placed in new buildings, and there are also a large number of listed buildings with sash window units which have to be restored, and in which the sash windows must be retained, but where sound and heat insulation are essential. Therefore there exists a need of improving known sash units.

The object of the present invention is to provide a solution to the abovementioned problems and to provide a generally improved sash window unit. To that end the sash window unit according to the invention is characterised in that the guide parts are stationary, and that the closing means form part of the guideways.

According to the invention, it is therefore made possible to use a sash window in said unit with relatively small dimensions of the side members and consequently having a relatively small weight. The sash window can be closed in an essentially airtight and soundproof fashion, without the sealing means being impeded in any way during the upward movement of the sash window in the frame, and so-called "skewing" or pulling out of square of the sash window in the frame, possibly resulting in it becoming jammed, is also prevented.

Per se, stationary guide parts and closing means forming part of the guideway are known from FR-A-2 339 045, however the sash window unit disclosed therein differs from the present unit in the following aspects. The movement of the sash window relative to the frame is relatively large and every guideway comprises more tracks. Further, during opening of said sash window the movement of the window does not take place at substantially right angles to the plane of the window, but the window has to be tilted first.

The guide parts used in the sash window unit according to the invention can be any guide part known in the art ranging from guide wheels to solid guide blocks and even guide strips.

The closing means advantageously comprise a locally curved path in the guideway. This embodiment will be explained in further detail in the description of the drawing. However, the basic principle lies in the fact that the locally curved path of the guideway is such that on a downward movement of the sash window, due to the curved path of the guideway, the sash window is forced against the frame, with the interposition of the sealing means.

The above embodiment of the sash window unit has a limited distance over which the window can be moved, which is determined by the distance between the curved paths.

In a more prefered embodiment the guideway has a stepped cross-section, comprising two or more guiding levels, and that each level of the guideway comprises a locally curved path, and can interact with one or more corresponding guide parts, in which a guide part which can interact with a deeper guiding level has a smaller diameter and a greater length than an adjacent guide part which can interact with a shallower guiding level, and that the guide part with the smaller diameter can be moved past the locally curved path of the shallower guiding level for the adjacent guide part.

In this way the distance over which the window can be moved is greatly increased and depends on the number of levels in the guideway. A further advantage of this embodiment is that with the same or even a larger maximum moving distance of the window the number of guide parts can be increased, such that during the movement of the window at substantially right angles to the sliding direction thereof the forces exerted on the guide parts are divided over more guide parts.

Preferably, the closing means comprise the guideway or a part thereof, with the interposition of a suitable coupling, being movable by means of one or more operating parts. All moving parts are associated with the guideways and the guide parts are stationary.

In particular, the coupling in the previous embodiments is designed in the form of a draw bar, which is provided locally with one or more projections which can interact with suitably shaped recesses in the part to be moved, and which can be moved by means of one or more operating handles. Apart from a draw bar, other transmission mechanisms are also conceivable here, such as a rack and pinion or chain mechanism.

The sash window can be brought into sealing contact with the frame at any desired height position by moving the guideway or a part thereof relative to the frame.

Advantageously, the guideways comprise at least one switch which can pivot about a hinge point and can be operated by the coupling to be moved between three positions, a fixed open position, a position aligned with the guideways, and a closed position. This embodiment will be explained in detail in the description of the drawing.

In a particular advantageous embodiment the closing means comprise the guideway or a part thereof being connected in a movable manner to the frame, with the interposition of auxiliary guide means, and being connected to spring means, said guideway or a part thereof having a stop which can interact with a carrier on the sash window.

In this embodiment the sash window can be moved up and down, without any transverse movement, but when the sash window is moved to the closed position the stop on the guideway or a part thereof is carried along by the carrier, one of the guide parts, or the sash window itself, with the result that the guideway or a part thereof, through the presence of the auxiliary guide means, is moved at substantially right angles to the sliding direction of the sash window. The sash window is thereby taken in the same direction and forced against the frame, with the interposition of the sealing means.

The invention will be explained in greater detail below with reference to the appended drawing, in which:

FIG. 2 shows a view in perspective of a part of a frame of a sash window unit according to the invention, with a guideway with locally curved path;

Figure 5B:
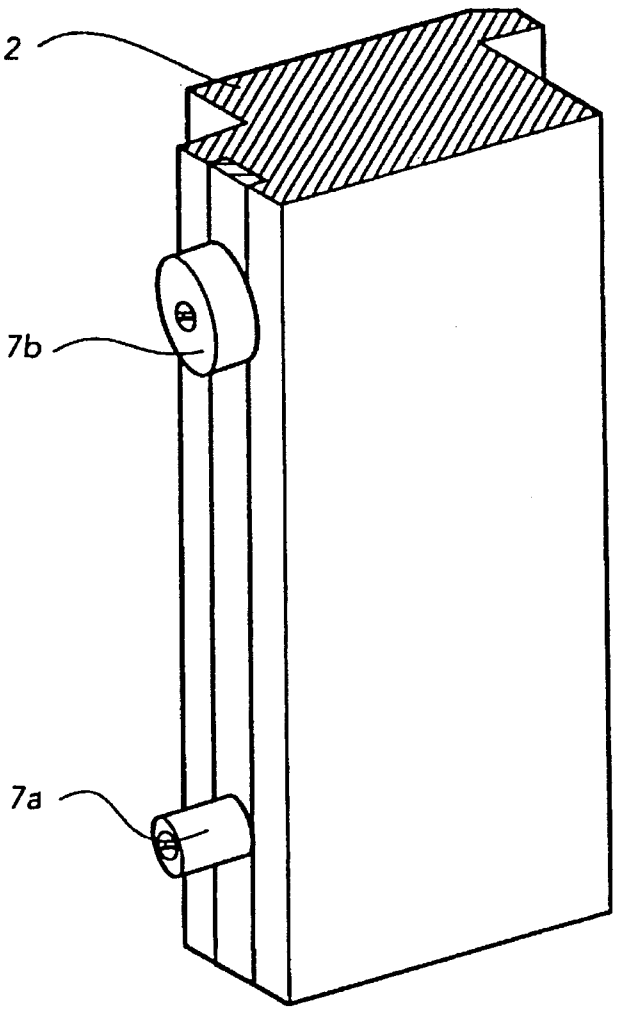
Figure 5A:
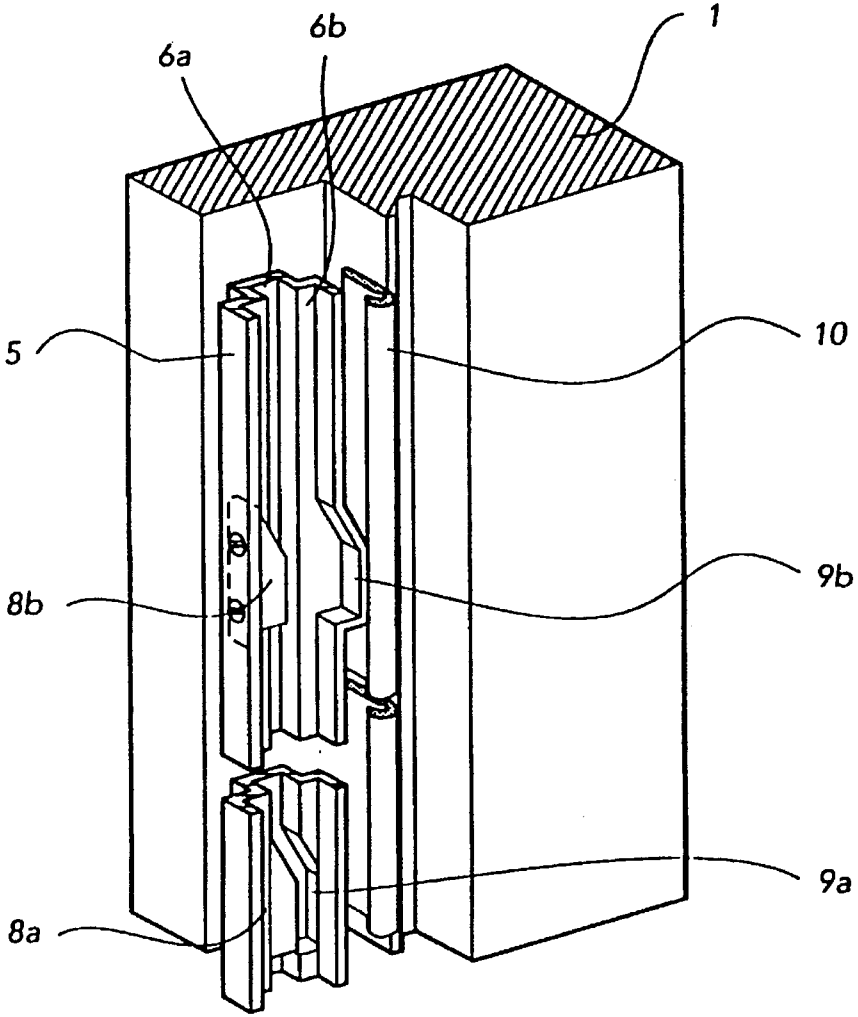

FIGS. 3*a* and 3*b* show a view in perspective of a disassembled part of a sash window unit with a frame according to FIG. 2;

FIGS. 4*a* and 4*b* show a view in perspective of a dismantled part of the sash window unit according to FIG. 3, with a burglarproof lock;

FIG. 5*a* shows in perspective a part of the frame of an improved embodiment of the sash window unit according to FIG. 2;

FIG. 5*b* shows in perspective a part of the corresponding sash window for the frame of FIG. 5*a;*

Figure 5C:
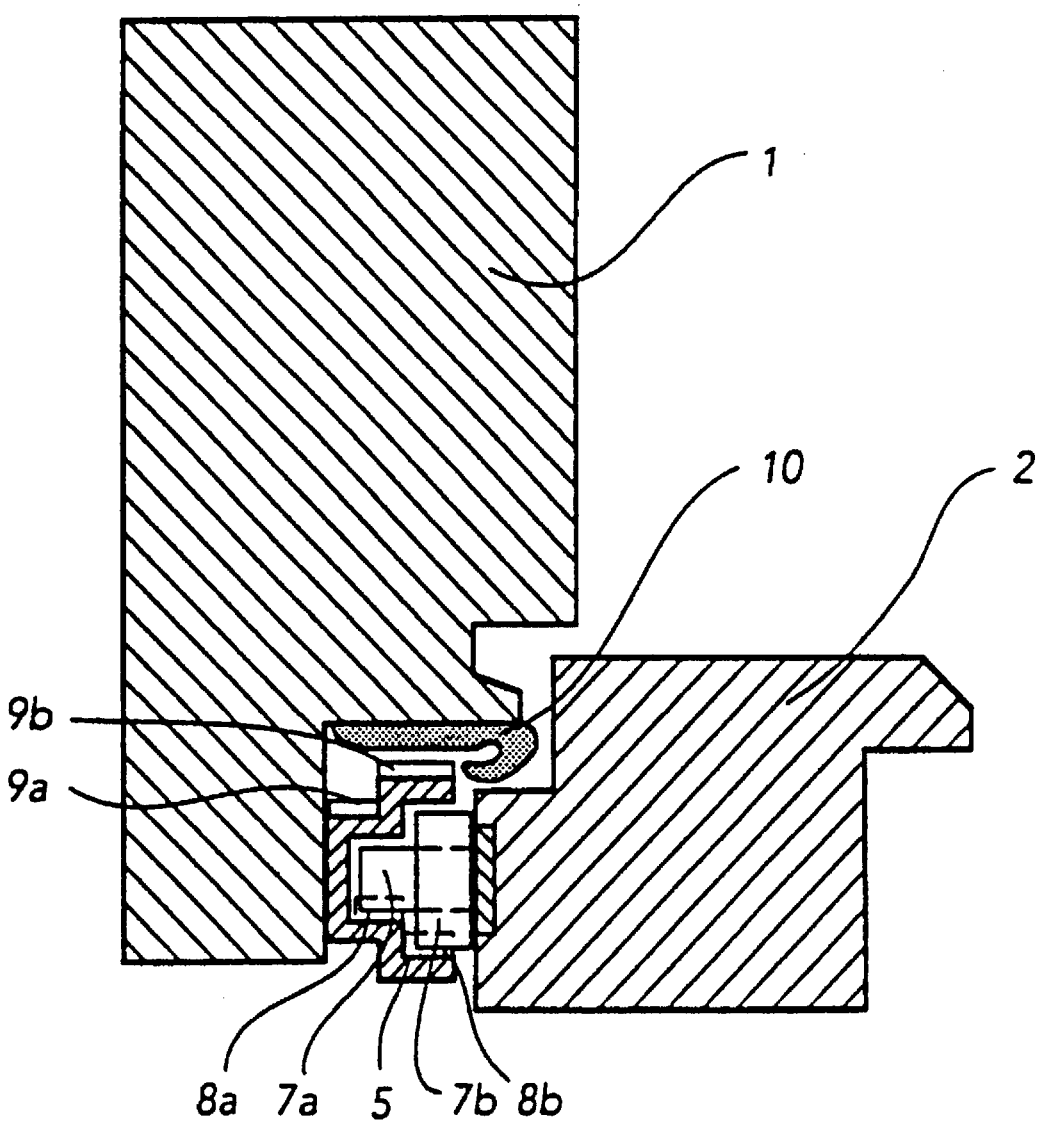
Figure 5B:
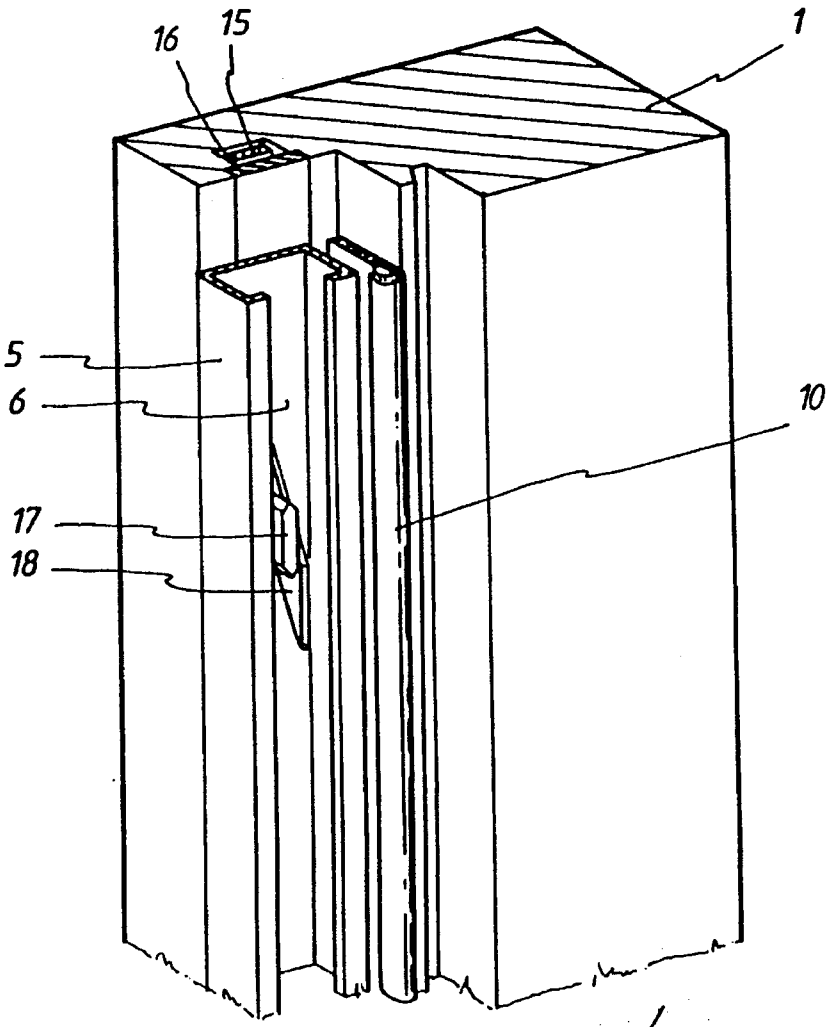
Figure 5A:
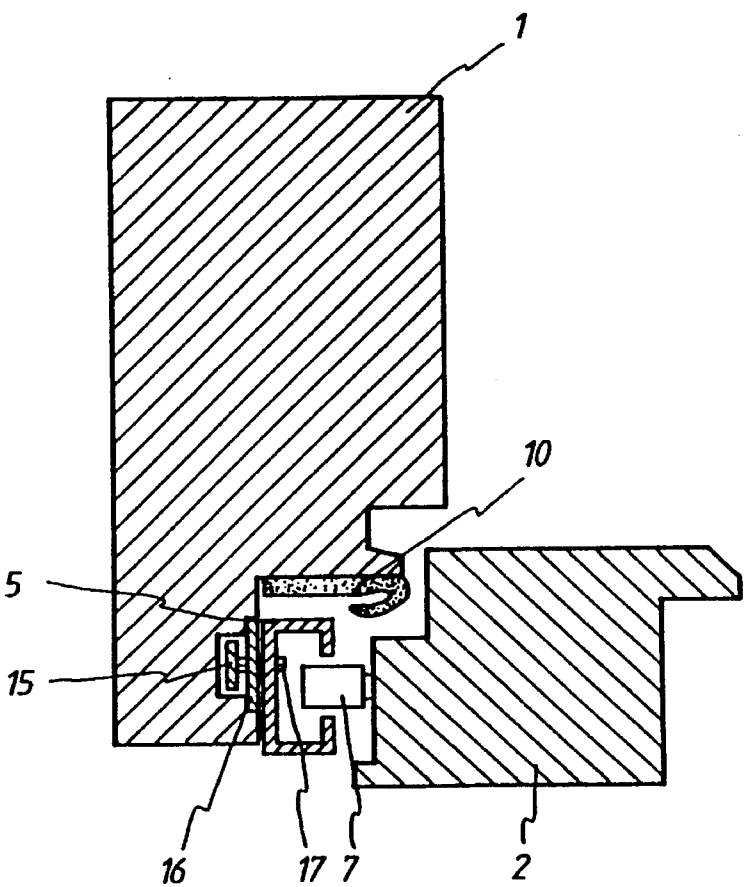

FIG. 5*c* shows a cross-section of the frame and sash window according to FIGS. 5*a* and *b* in assembled condition;

FIG. 6*a* shows a cross-section of a sash window and a frame, with a movable guideway on the frame;

FIG. 6*b* shows a view in perspective of a part of the frame according to FIG. 6*a;*

Figure 7B:
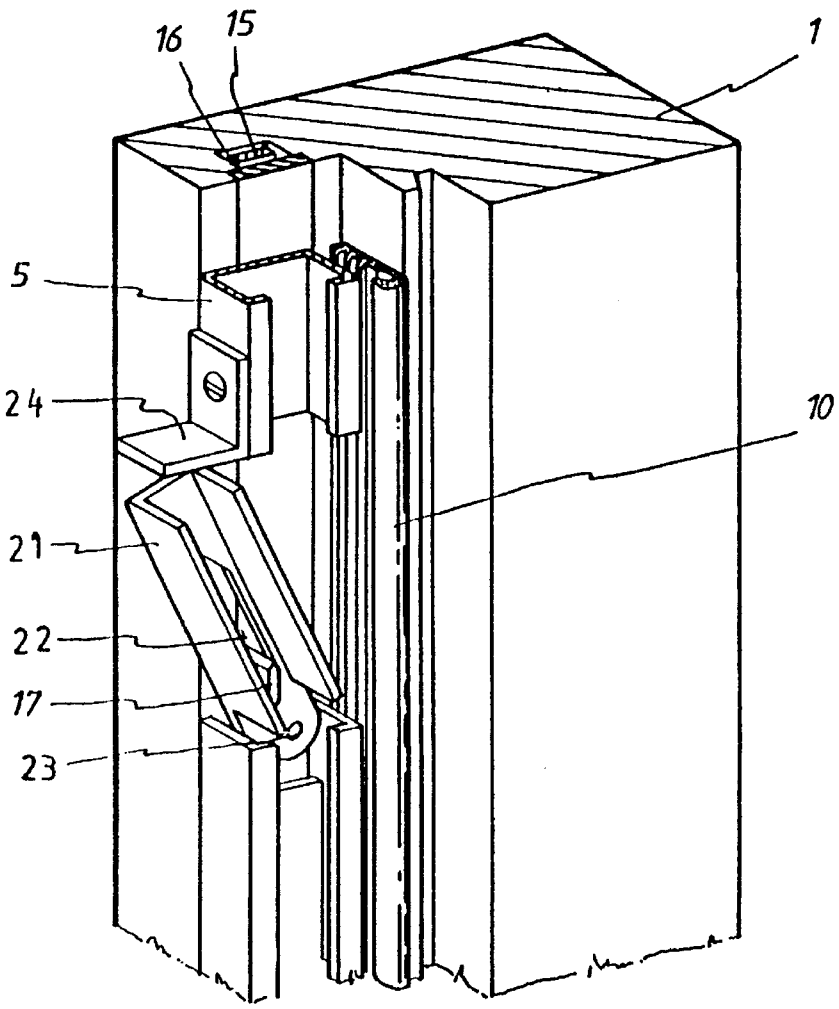
Figure 7A:
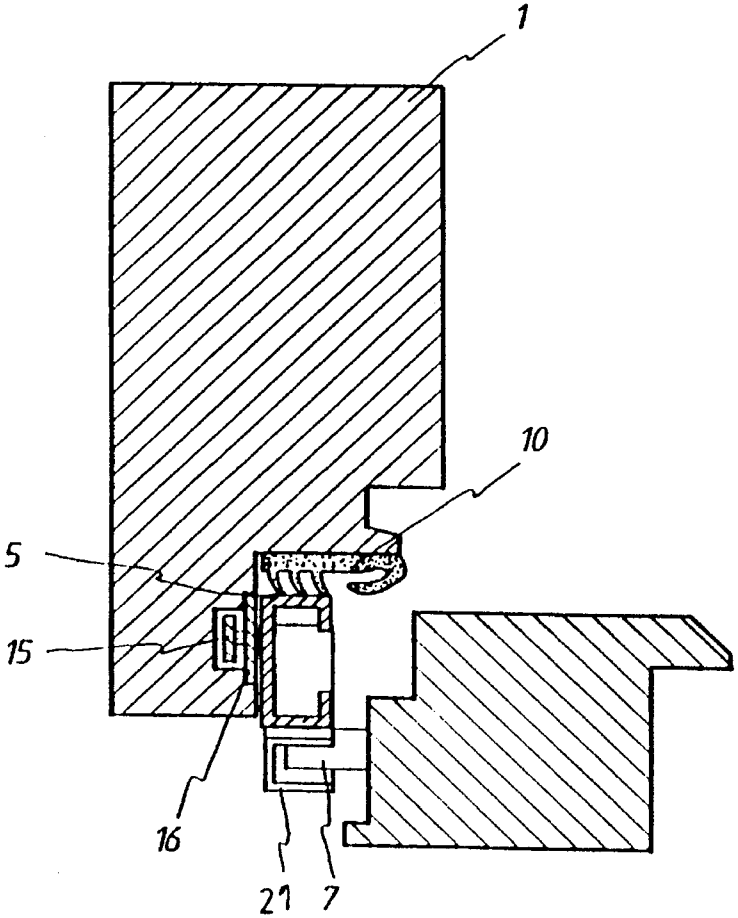

FIG. 7*a* shows a cross-section of a frame and a window, in which a part of the guideway is movable;

FIG. 7*b* shows a view in perspective of a part of the frame according to FIG. 7*a;*

Figure 8B:
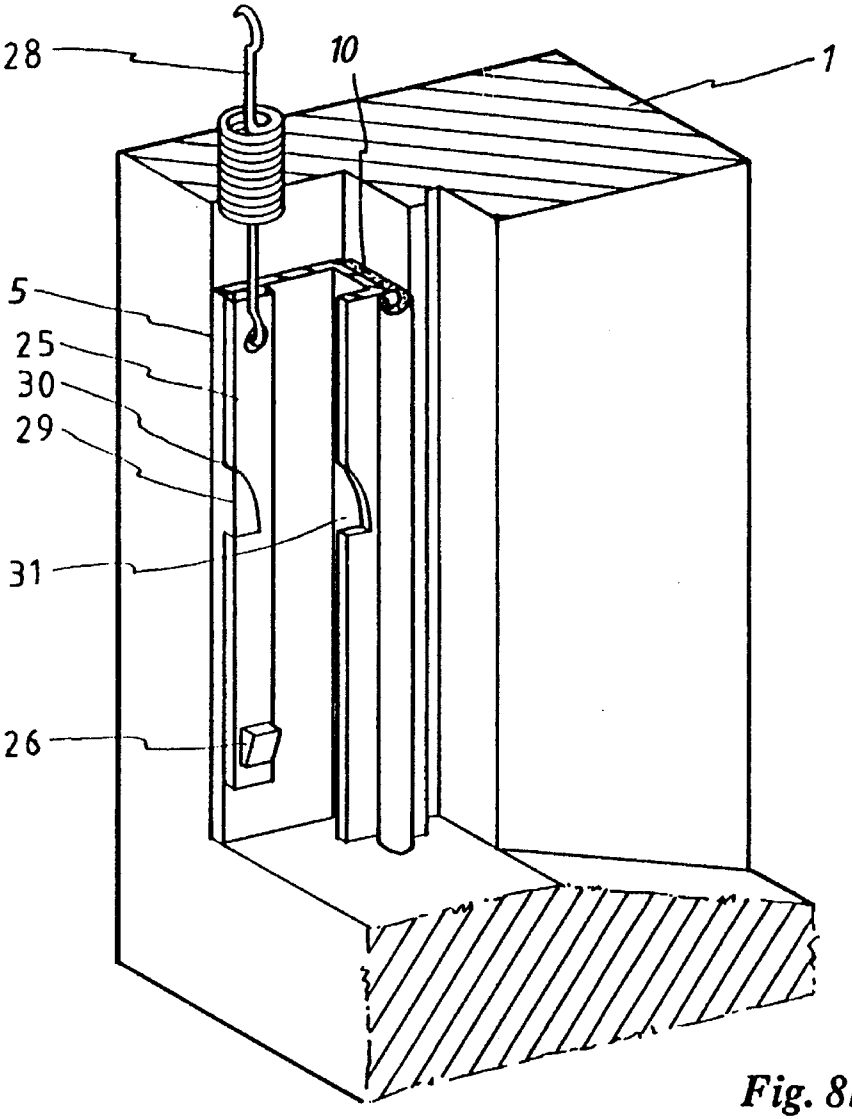
Figure 8A:
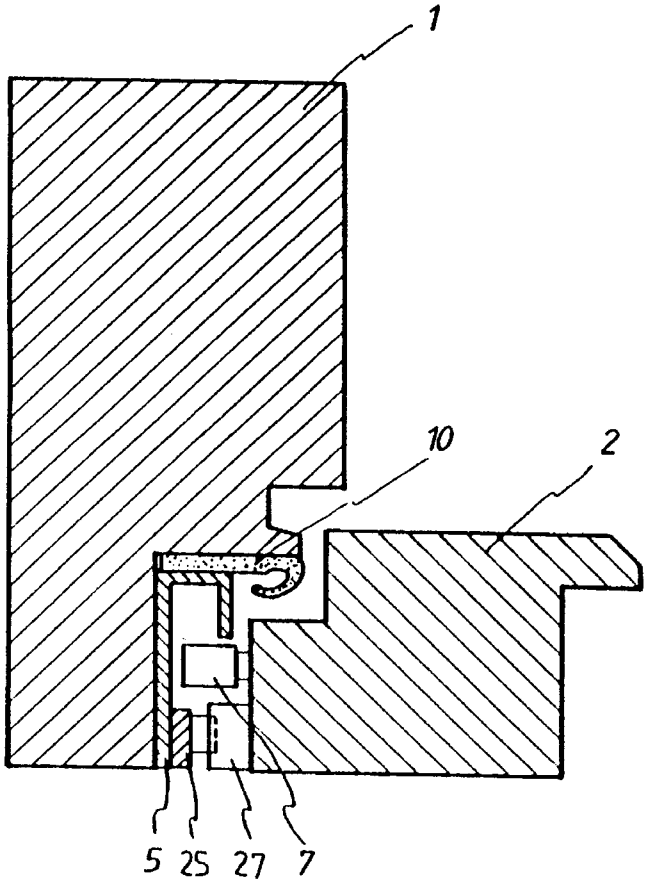

FIG. 8*a* shows a cross-section of a frame and a sash window, in which a part of the guideway on the frame is connected to a spring;

FIG. 8*b* shows a view in perspective of a part of the frame according to FIG. 8*a;*

Figure 9A:
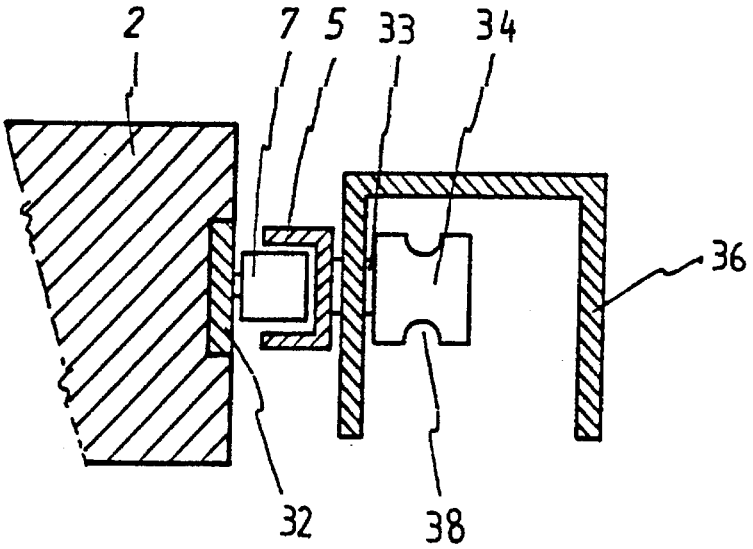
Figure 9B:
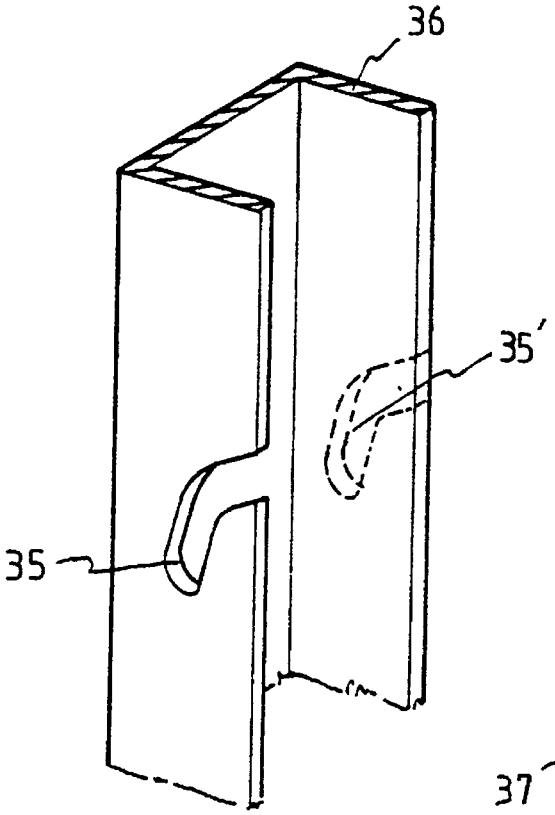
Figure 9C:
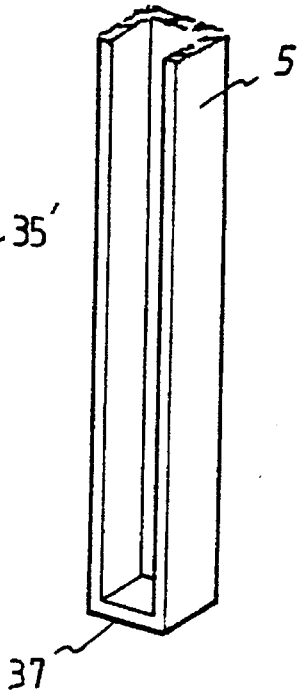
Figure 9D:
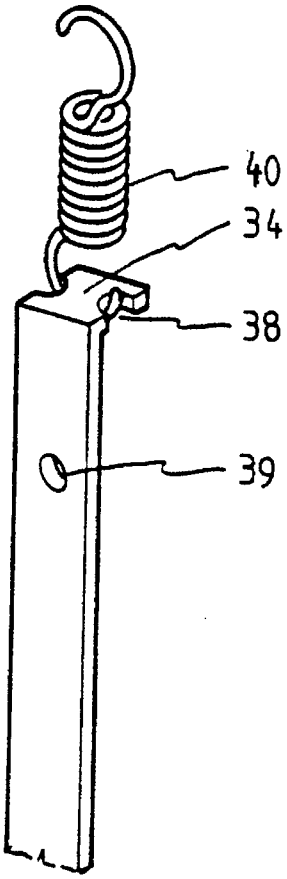
Figure 10:
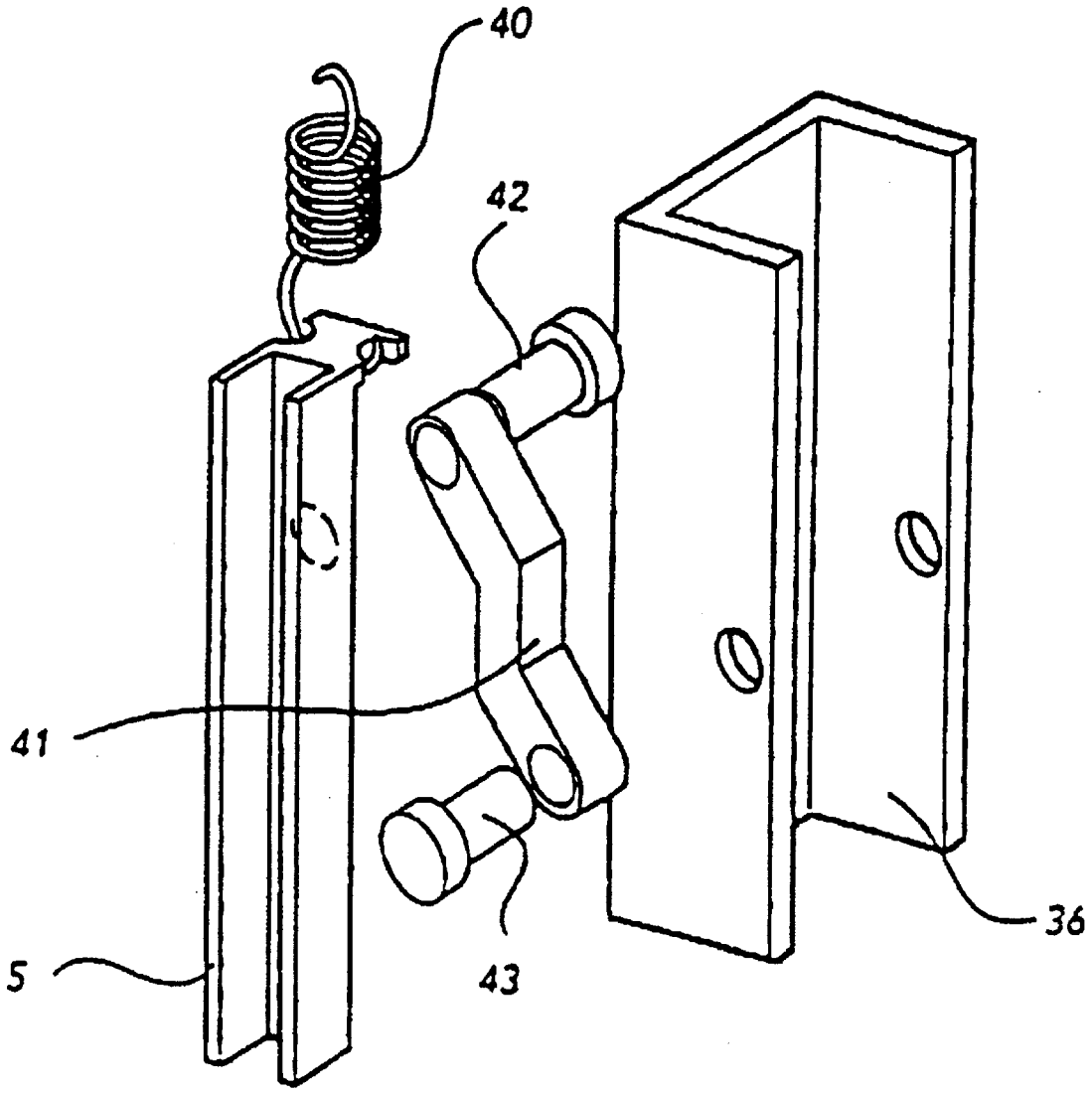

FIG. 9*a* shows a diagrammatic cross-section of a sash window and a weight shaft, in which the guideway is movable along a certain path and is connected to a spring;

FIGS. 9*b*–9*d* show a view in perspective of a part of a number of parts from FIG. 9*a*; and FIG. 10 shows a view in perspective of a part of another embodiment of the sash window unit according to FIGS. 9*a*–9*d*.

Figure 1:
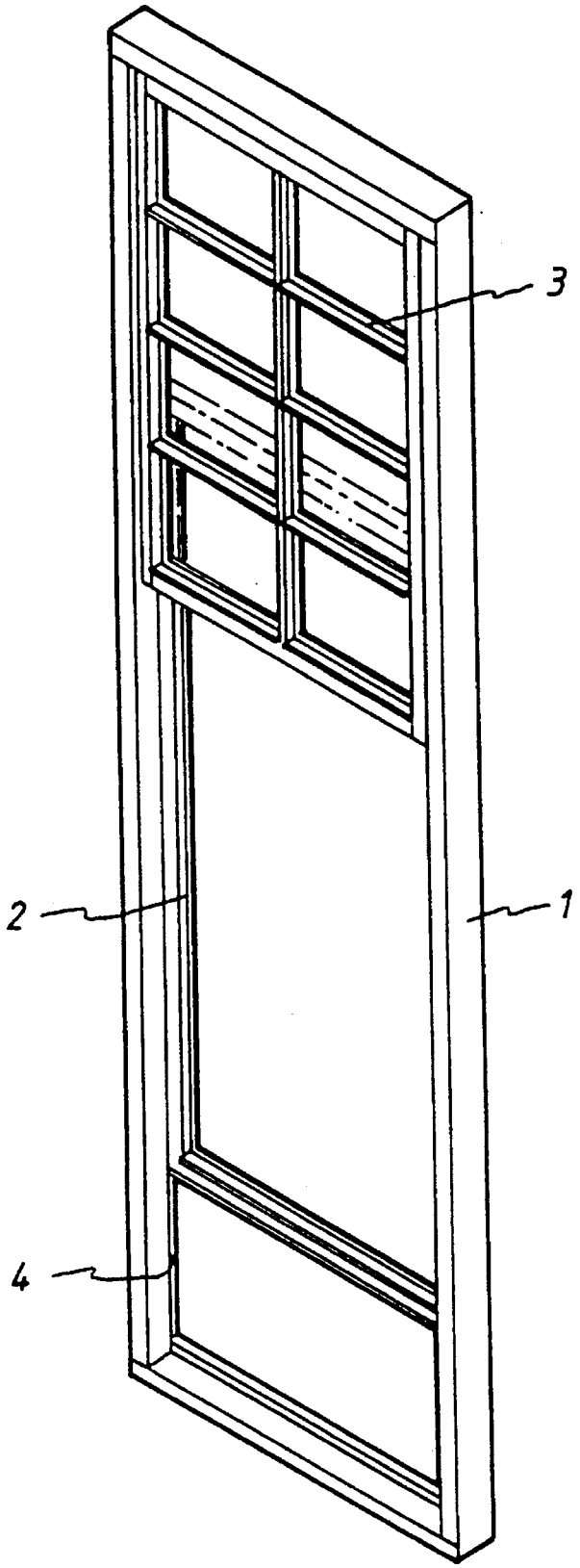
FIG. 1 shows a view in perspective of a common sash window unit in a partially opened position.

FIG. 1 shows a perspective view of a common sash window comprising a frame 1 containing a sash window 2. The frame generally also comprises a fixed top window 3, but there are also sash windows in which a space into which a sash window can slide is present above the frame. The sash window 2 in FIG. 1 is shown in a partially open position, so that the guideway 4 in the vertical members of the frame is visible. This guideway is a simple guideway comprising a groove in the frame, into which the sash window can be slid with an edge of complementary shape of the side member thereof.

FIG. 2 shows a view in perspective of a part of a vertical member of a frame 1 of an embodiment of a sash window unit according to the invention, in which the guideway is formed by a tubular section 5 with a groove 6 in which guide parts 7 situated on the sash window 2, which can be seen in FIG. 3*b* and FIG. 4*b*, can be guided. These guide parts are preferably sliding blocks or wheels, by means of which a very smooth, low-friction guiding is obtained.

A curved path is formed locally in the guideway 5, through the presence of a shoulder 8 and a recess 9 in the guideway 5. If the sash window 2 is moved in the downward direction in the guideway 5, when a wheel 7 passes the shoulder 8 the sash window 2 will be pressed against the frame 1, with the interposition of the seal 10, which is designed in the form of a rubber section. The transverse movement imposed by the curved path of the guideway 5 is such that, on opening the sash window, the window is just detached from the seal 10. Needless to say, a corresponding guideway 5 is present on both vertical members of the frame 1, the number of shoulders and recesses 9 corresponding to the number of guide wheels on the sash window.

FIGS. 3*a* and 3*b* show in perspective, and disassembled, both a part of the frame of the embodiment according to FIG. 2 and of the sash window 2, with double glazing 11 therein.

In the figures we shall not go into any further detail on the means for holding the sash window balanced in an open position, since these are generally known and, as discussed earlier, can be made in the form of a counterweight in a weight shaft, which is connected to the sash window by means of a cord or a belt by way of a pulley.

FIGS. 4*a* and 4*b* show in perspective, and disassembled, the frame and the sash window according to FIG. 3, with a burglar lock being present. The latter comprises a draw bar 12 which can be operated by means of a rotatable handle 13. In the closed position of the sash window one end of the draw bar 12 can be moved into a recess 14 in the frame 1, in order to make it impossible to open the window from the outside.

FIGS. 5*a* and 5*b* show in perspective a side member of the frame 1 and a sash window 2 which together form an improved embodiment of the unit as shown in FIG. 2. In this embodiment the guideway 5 comprises a stepped cross-section, defining two guiding levels 6*a* and 6*b*, which can interact with guide wheels 7*a* and 7*b* respectively. Further the guiding levels 6*a*, 6*b* each comprise at least one locally curved path formed by respectively shoulder 8*a* and recess 9*a*, and shoulder 8*b* and recess 9*b*. Each level usually comprises two or more of these curved paths.

The shoulders and recesses all define the same curved path, such that during closing of the window the respective guide wheels are all displaced over substantially the same distance. In FIG. 5*a* the respective curved paths of the two levels 6*a*, 6*b* are shown rather close together separated by a break line. They will be further apart in practice. The distance between the curved paths equals the distance between the corresponding guide wheels 7*a*, 7*b*.

Guide wheel 7*a*, comprising the smallest diameter and the largest length, is guided in guiding level 6*a* and guide wheel 7*b*, with a larger diameter and a smaller length, is guided in guiding level 6*b*. If the sash window is pushed upward guide wheel 7*a* can pass the curved path in guiding level 6*b* formed by shoulder 8*b* and recess 9*b*. When the window is moved downwards and the guide wheels 7*a*, 7*b* meet the respective shoulders 8*a*, 8*b* the window is forced against the frame 1 with the interposition of the seal 10, during which movement the guide wheels 7*a*, 7*b* are displaced over substantially the same distance.

Of course, the number of guiding levels can be increased as required. The number of guide wheels will then also increase correspondingly. With this embodiment it is possible that when e.g. three guiding levels are used and three sets of corresponding guide wheels, with a distance between the guide wheels of 0.5 m, the window can be opened over a distance of 1.5 m.

In FIG. 5*c* a cross-section is shown of the frame 1 and sash window 2 of the previous FIGS. 5*a* and 5*b* in an assembled condition.

FIGS. 6*a* and 6*b* show in cross-section and in perspective respectively a side member of a frame 1 and a window 2 of a sash window unit according to the invention, in which the guideway 5 can be moved relative to the frame using a draw bar 15. The latter is situated in the frame 1 behind a cover plate 16, and a projection 17 thereof projects through the cover plate 16 into a suitably shaped recess 18 present in the guideway 5. The draw bar 15 can be operated with the aid of suitable operating parts, such as a crank or handle on the frame. When the draw bar 15 is moved upwards by the operating parts, the guideway 5 will be moved to the seal 10, owing to the shape of the recess 18, with the result that the window, whose guide wheels 7 are situated in the guideway 5, will be pressed against the seal 10.

FIGS. 7*a* and 7*b* show an embodiment in which a vent opening of the window can be achieved through displacement of the draw bar 15, but in which it is ensured that the window cannot be opened any further from the outside. The guideway 15 comprises at least one switch 21 which can pivot about a hinge point 23 and also has a recess 22 which can interact with the projection 17 of the draw bar 15 situated in the frame 1. If the window is closed, with a guide wheel in the switch 21, when the draw bar is moved downwards the switch will turn to the position shown in FIG. 7*b*, and the window can be opened slightly. The stop 24 prevents the guide wheel 7 from running out of the switch in this position, due to the window being moved upwards. When the stop 24 is removed, the sash window 2 is simple to slide out of the frame 1.

If the draw bar 15 is moved the other way, the switch 21 is first of all moved to a position parallel to the guideway 5, at which moment the window can be slid to any desired height in the frame 1. When the switch is moved again, the window 2 is moved against seal 10.

Another embodiment of the sash window unit according to the invention comprises a more passive seal, which does not require any active operation of a draw bar. Examples of this are shown in FIGS. 8*a*, 8*b*, FIGS. 9*a*–9*d* and FIG. 10.

FIGS. 8*a* and 8*b* show an embodiment in which the guideway 5 contains a draw bar 25 which is provided with a stop 26, which can be moved along by a carrier 27 on the sash window 2 when the sash window is moving downwards. The draw bar 25 is suspended in a spring-loaded manner by means of a spring 28, so that when the window moves up again it returns automatically to its position. A thickened part 29 in the guideway 5, a recess 30 in the draw bar 25 interacting therewith, and a recess 31 in the guideway 5 are also present. If the sash window 2 is moved downwards, the draw bar 25 is moved downwards when the carrier 27 makes contact with the stop 26, and the interaction of the thickened part 29 with the recess 30 in draw bar 25 causes movement of said draw bar 25, which acts upon guide wheel 7 and thereby presses the window 2 against the seal 10. Usually more of these thickened parts with interacting recesses and adjacent recesses in the guideway 5 will be present to match the number of guide parts.

A particularly elegant embodiment of this is shown in cross-section in FIG. 9*a*, in which guide wheels 7 are fixed to a fixing plate 32 on the sash window 2, and in which the guideway 5 is connected to a spring fixing rod 34, with the interposition of a connecting pin 33. The pin 33 is situated in a guideway 35 in a weight shaft 36. An additional guideway is shown by 35', by means of which the weight shaft is both left-handed and right-handed and can be used on both sides of a frame. The spring fixing rod 34 in FIG. 9*d* contains spring fixing recesses 38 for fixing a spring 40, and also has an opening 39 for fixing the pin 33. The spring 40 can be fixed at the other end in a top enclosure (not shown) of the weight shaft 36. This top enclosure generally also contains the pulley for guiding the cord or the strap for connecting the sash window 2 to the counterweight.

This embodiment of the sash window unit works as follows. The window 2 can be moved up and down in the guideway 5 without movement of the guideway 5 or the spring fixing rod 34, but when the sash window 2 is moved to the closed position, as soon as the lower guide wheel 7 touches the closed end 37 of the guideway 5 the guideway 5, and thus the spring fixing rod 34, will be carried along. The lower guide wheel 7 is advantageously adjustable in height, so that the unit can be adjusted. The pin 33 is then displaced in the guideway 35, with the result that a transverse movement is imposed on the sash window 2. The sash window 2 is thereby pressed against the seal 10, as shown in the preceding figure. The pin 33 can also be provided with a wheel which fits into the slot 35, in order to improve the guidance in this slot 35.

For the sake of clarity it is pointed out that the top side of the weight shaft 36 is shown in FIG. 9*b* and that recesses 35, 35', distributed at several points in the vertical direction, can be present. FIG. 9*c* shows the bottom side of the guideway 5, which extends over virtually the entire length of the weight shaft 36. FIG. 9*d* shows the top end of the spring fixing rod 34 with an opening 39. Over the length of this rod 34 there are as many openings 39 present as there are recesses 35, 35' in the weight shaft 36. The guideway 5 also contains a corresponding number of openings for fixing the pins 33.

Preferably in this embodiment a guide strip is used instead of guide wheels 7, extending over substantially the entire length of the sash window 2.

In FIG. 10 another embodiment of the unit according to FIGS. 9*a*–*d* is shown. In this case the rod 34 is omitted and the spring 40 is secured to the guideway 5. Further the pin 33 and guideways 35, 35' are substituted by an arm 41 with two pivot pins 42 and 43. This embodiment works the same as the previous embodiment, the auxiliary guiding means being designed as a pivotable arm instead of a pin and guideway.

It will be clear that, on the basis of the above description, many variants of the sash window according to the invention will be obvious to the average person skilled in the art.

I claim:

1. A sash window unit comprising a frame, a sash window, rubber sealing means between said sash window and said frame, and guide means slideably coupling said sash window to said frame; said guide means comprising at least two guideways and at least two guide parts, each one of said guide parts adapted to engage one said guideway, at least one of said guideways comprising a portion defining a locally curved path for moving said sash window in a direction generally at right angles to the plane of said sash window, thereby bringing said sealing means into contact with said frame and said sash window.

2. A sash window unit comprising a frame, a sash window, sealing means between said sash window and said frame, and guide means slideably coupling said sash window to said frame, said guide means comprising first and second guiding levels and first and second guide parts, each of said guiding levels comprising a portion defining a locally curved path for moving said sash window in a direction generally a right angles to the plane of said sash window, wherein said first guiding level is deeper and narrower than said second guiding level, and wherein said first guiding level engages said first guide part and said second guiding level engages said second guide part, said first guide part being longer and narrower than said second guide part, and wherein said first guide part can move past said locally curved path portion of said second guiding level without following said locally curved path portion of said second guiding level.

3. A sash window unit according to claim 2, wherein said first and second guide parts comprise guide wheels having diameters adapted to fit within said first and second guiding levels, respectively.

4. A sash window unit according to claim 3, wherein said guideways comprise a channel in said frame and said guide wheels are attached to said sash window.

5. A sash window unit according to claim 2, wherein said locally curved path portions of said guiding levels comprise a shoulder portion and a recess portion.

6. A sash window unit according to claim 2, wherein said sealing means comprise a rubber sealing strip.

* * * * *